US005860278A

United States Patent [19]

Rodenkirch

[11] Patent Number: 5,860,278

[45] Date of Patent: Jan. 19, 1999

[54] APPARATUS AND METHOD FOR PROVIDING A COMPACT LOW PRESSURE DROP EXHAUST MANIFOLD

[75] Inventor: Norman E. Rodenkirch, Chelsea, Mich.

[73] Assignee: Chrysler Corporation, Auburn Hills, Mich.

[21] Appl. No.: 772,294

[22] Filed: Dec. 23, 1996

[51] Int. Cl.[6] ..... F02B 27/02

[52] U.S. Cl. ..... 60/313; 60/323; 60/274

[58] Field of Search ..... 60/313, 323

[56] References Cited

U.S. PATENT DOCUMENTS

| | | | |
|---|---|---|---|
| 1,294,475 | 2/1919 | Kirkham . | |
| 1,327,311 | 1/1920 | Chesnutt . | |
| 1,761,960 | 6/1930 | Armitage | 60/323 |
| 1,775,511 | 9/1930 | Chapman . | |
| 2,000,722 | 5/1935 | Steward | 60/323 |
| 2,230,666 | 2/1941 | Martin et al. . | |
| 4,023,365 | 5/1977 | van Ginhoven . | |
| 4,288,988 | 9/1981 | Curtil . | |
| 4,689,952 | 9/1987 | Arthur et al. | 60/313 |
| 5,331,930 | 7/1994 | McWhoter | 123/79 R |

FOREIGN PATENT DOCUMENTS

| | | |
|---|---|---|
| 52022 | 6/1938 | France . |
| 139282 | 6/1929 | Germany . |
| 842873 | 5/1950 | Germany . |
| 3334413 | 3/1984 | Germany . |
| 224116 | 1/1943 | Switzerland . |
| 352912 | 1/1930 | United Kingdom . |

*Primary Examiner*—Thomas E. Denion
*Attorney, Agent, or Firm*—Kenneth H. Maclean

[57] ABSTRACT

An exhaust manifold with several inlet ports and a combination of diffuser and nozzle portions associated with each inlet port for producing a high flow rate and a low pressure drop from entry to exit. The diffuser and nozzle portions are in series and designed into the manifold at each inlet port and slightly upstream of the next downstream positioned inlet port. The diffuser portion decreases the velocity of exhaust gasses as they enter the manifold and are then turned substantially ninety degrees into a longitudinal direction of the manifold. This diffuser action slows the velocity and reduces pressure losses as the turn of exhaust flow is accomplished. The next in series nozzle portion increases the velocity of exhaust gases to cause the flowstream to jump past a neighboring downstream engine exhaust port. Resultantly, the flow through the manifold is improved and the pressure drop decreased which enhances engine performance. Also, the heat rejection and thermal inertia of the manifold is decreased which enhances the earlier heating and light-off of a downstream catalyst of a gas treatment unit.

8 Claims, 3 Drawing Sheets

FIG-1
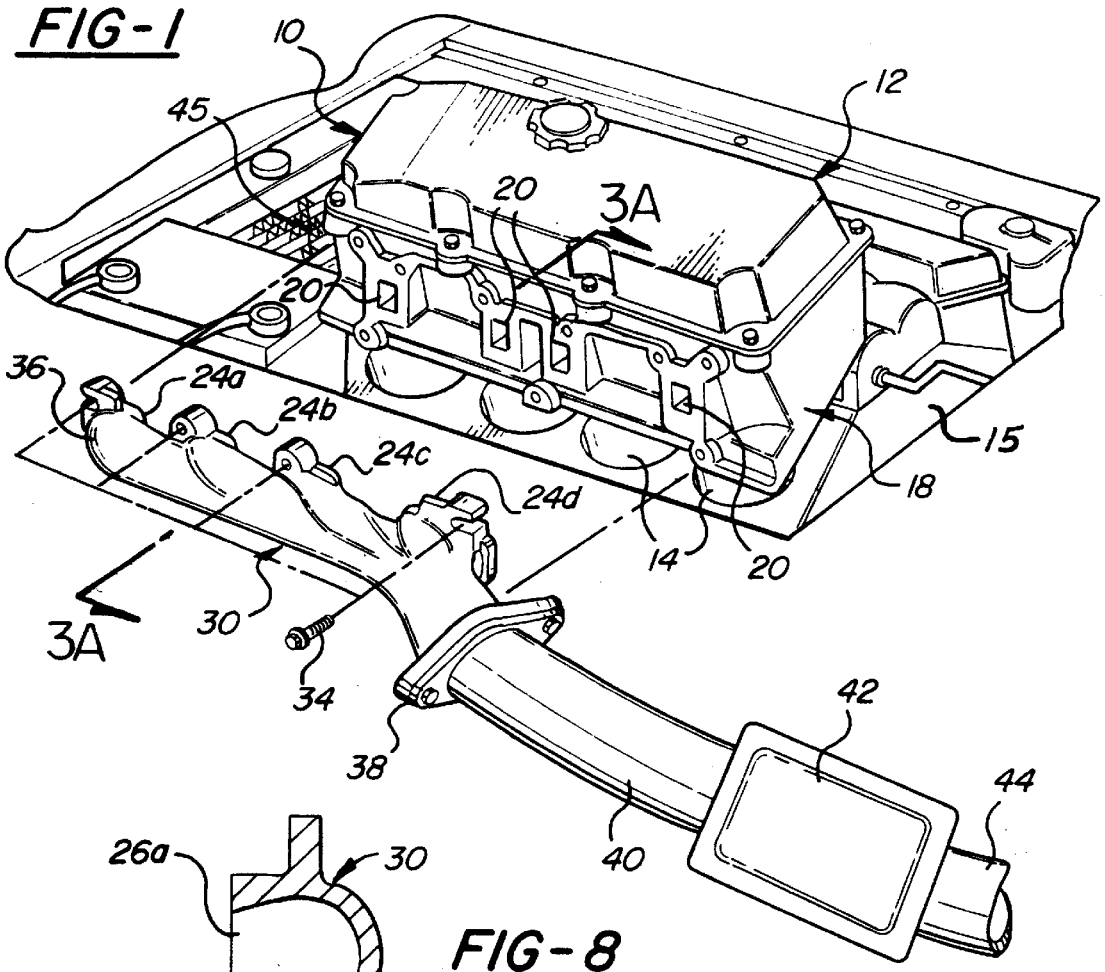
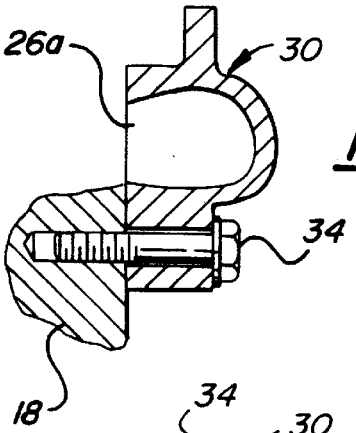
FIG-8
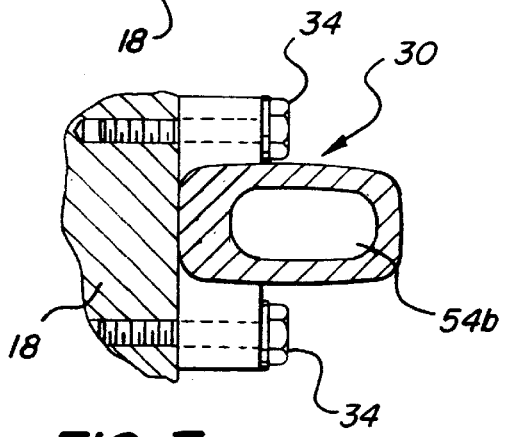
FIG-7
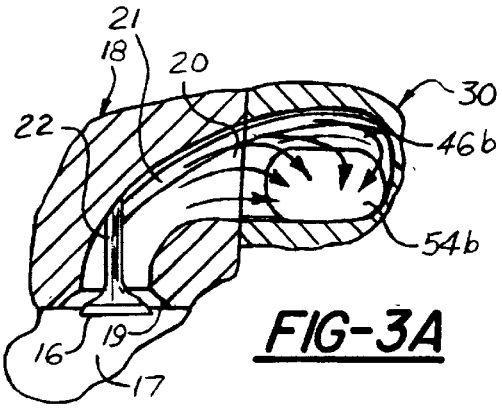
FIG-3A

APPARATUS AND METHOD FOR PROVIDING A COMPACT LOW PRESSURE DROP EXHAUST MANIFOLD

FIELD OF THE INVENTION

This invention relates to exhaust flow control methods and an improved engine manifold which is readily adaptable to a crowded vehicle engine compartment while also providing a decreased pressure drop, reduced exhaust gas residence time in the manifold and a low heat transfer. This improved manifold enhances engine performance, provides an earlier light-off of a catalyst in a downstream exhaust treatment system, and reduces heat rejection from the manifold to the engine compartment.

BACKGROUND OF THE INVENTION

Prior to the present invention, various exhaust manifolds and methods of controlling exhaust gases have been disclosed in the prior art. U.S. Pat. No. 2,230,666 which issued Feb. 4, 1941 and is entitled "EXHAUST GAS COLLECTOR" discloses a plurality of laterally spaced exhaust pipes fluidly connected to the cylinders of an associated internal combustion engine open to a diverging funnel-like main exhaust tube providing reduced back pressure and thereby increasing the power of the engine. U.S. Pat. No. 4,288,988 which issued Sep. 15, 1981 and is entitled "METHOD AND APPARATUS FOR IMPROVING THE GAS FLOW IN AN INTERNAL COMBUSTION ENGINE EXHAUST MANIFOLD" discloses a method and apparatus for damping pressure oscillations in the exhaust manifold of an associated engine by throttling the exhaust gas near the outlet of the cylinders and then accelerating the gas flow in the manifold by providing a uniform flow section therein which is substantially smaller than the cylinder bore.

While these and other prior manifold constructions control flow of engine exhaust gas as disclosed, they do not meet the very high performance standards required for compact manifolds and effective manifold operation characterized by low thermal inertia necessary for early light-off of a downstream catalytic converter as now utilized in exhaust treatment in present automotive vehicles. Furthermore, with the advent of crowded engine compartments as found in practically all modern vehicles, these prior designs are generally not suitable because of their bulky configurations.

SUMMARY OF THE INVENTION

The subject improved manifold has an elongated tubular body portion and spaced apart inlet branches therealong, each inlet branch receiving exhaust gasses from one of the associated engine combustion chambers. The tubular portion defines a longitudinally extending main exhaust passage which has an outlet at one end that is operatively connected to the vehicle's catalytic converter and then to the muffler and exhaust system that discharges the treated exhaust gases.

In this invention, exhaust flow is effectively managed by configuring the manifold to provide diffuser and nozzle portions at each entry for exhaust gasses into the manifold. Thereby, directional control of the exhaust gas is maintained in a small space, the drop in pressure through the manifold is low and thus back pressure is decreased. Resultantly, a smaller and reduced-mass exhaust manifold is created having a low thermal inertia. Accordingly, the present invention is drawn to a new and improved exhaust manifold construction to effectively manage flow of engine exhaust gases.

Another feature, object and advantage of this invention is to provide a new and improved exhaust flow process for treating the gasses passing into each inlet portion of the manifold from a combustion chamber by: diffusion of the flow produced by an expanded passage profile while the flow direction is changed; then by concentrating the flow by convergence as produced by a progressively decreased passage defining a nozzle profile to cause the flow to speed by, or effectively jump, the next downstream located inlet to the manifold. Thus, the drop in overall pressure through the exhaust manifold is minimized.

Preferably, diffusion of exhaust gasses starts in the later portion of the exhaust passage of the engine cylinder head. Importantly, the diffusion process continues in an expanded profile of the manifold's inlet portion or diffuser section for each combustion chamber. In a diffuser section, kinetic energy of the exhaust gasses is converted into higher pressure but decreased velocity at a location in the manifold where the flow direction turns sharply from the lateral to the longitudinal direction of the manifold, normally about ninety degrees. The reduced velocity of the gas flow eases this direction changing or turning process. As a result, this is accomplished with relatively low pressure losses.

After the flow direction is changed, a nozzle section of the manifold having a decreasing profile concentrates gas flow. The increased pressure of the gas as in the diffusser section is converted into increased velocity and decreased pressure. The magnitude of the velocity change is sufficient to allow the gas to "jump" or bypass an adjacent downstream portion of the manifold serving the next engine exhaust port. This reduces turbulent interchange with the flow from the downstream exhaust port that is not in the exhaust cycle, i.e., exhaust valve is closed. With this manifold design and flow process, the volume of flow is optimized requiring a manifold with a smaller profile and a lower mass thereby enhancing engine performance and generating low thermal inertia. The heat loss from the manifold is thus minimized resulting in a more rapid light-off of the catalyst in a converter particularly during the engine start-up and warming cycle.

The exhaust port of the engine cylinder head associated with the invention preferably initiates a diffusion process. As the exhaust gas continues through an inlet portion of the manifold in a lateral direction relative to the manifold, the flow direction is turned through a sharp angle, normally about ninety degrees to a longitudinal direction relative to the manifold and towards the manifold outlet. During this turning of the flow in the diffuser section, especially along its top surface, the velocity of flow is reduced. This reduction in velocity permits the ninety degree turn with minimal total energy loss through the manifold. Immediately downstream from the diffuser section, a nozzle portion of the manifold concentrates the flow by a decreasing profile and converts the increased gas pressure created in the diffuser section into a an increase in velocity. The velocity increase is sufficiently high to cause the flow to bypass or jump the outlet from a downstream positioned entry for exhaust associated with next adjacent combustion chamber. The series positioned diffuser/nozzle sections are provided for each manifold inlet associated with an engine exhaust port.

Another object of this invention is to provide a new and improved exhaust manifold with each exhaust inlet to the manifold having first a diffuser section and then a nozzle section for providing an overall low pressure drop which tends to improve engine performance and to optimize catalytic converter operation, particularly right after engine start-up. The subject manifold has added utility when engine compartment space is scarce and it is advantageous for the exhaust manifold to have a low volume.

The subject manifold and flow process enhances catalyst operation by decreasing the time of catalyst light-off and effective catalytic converter operation due to the decreased heat rejection of the manifold and increased heat delivered to the catalyst because of the manifold's minimized volume and mass as well as the resultant low residence time of exhaust gas in the manifold. Accordingly, low mass of the manifold and decreased surface area for thermal conductivity allows the exhaust gas to quickly and effectively pass to the catalytic converter at a high temperature to obtain quick and early light-off of the catalyst. Furthermore, with the smaller engine compartments available today, the lower volume manifold is desirable. Also, the small manifold featured in this invention reduces heat transfer to the engine compartment because of its reduced surface area and the smaller manifold is more easily shielded.

These and other features, objects and advantages of the present invention will become more apparent from the following detailed description and drawings.

BRIEF DESCRIPTION OF THE DRAWINGS

FIG. 1 is a partial perspective view of a V-8 type engine in its engine compartment including separate views of the left cylinder head assembly and the exhaust manifold, each moved from their normal attachments to the engine and to the cylinder head respectively;

FIG. 3*a* is an elevational and sectioned view taken generally along sight lines 3*a*—3*a* in FIG. 1 with the manifold attached to the cylinder head;

FIG. 7 is a sectioned view of the manifold as attached to the cylinder head taken along sight line 7—7 in FIG. 2 and looking in the direction of the arrows; and FIG. 8 is a sectioned view of the manifold as attached to the cylinder head taken along sight line 8—8 in FIG. 2 and looking in the direction of the arrows.

DETAILED DESCRIPTION OF THE PREFERRED EMBODIMENT

Figure 2:
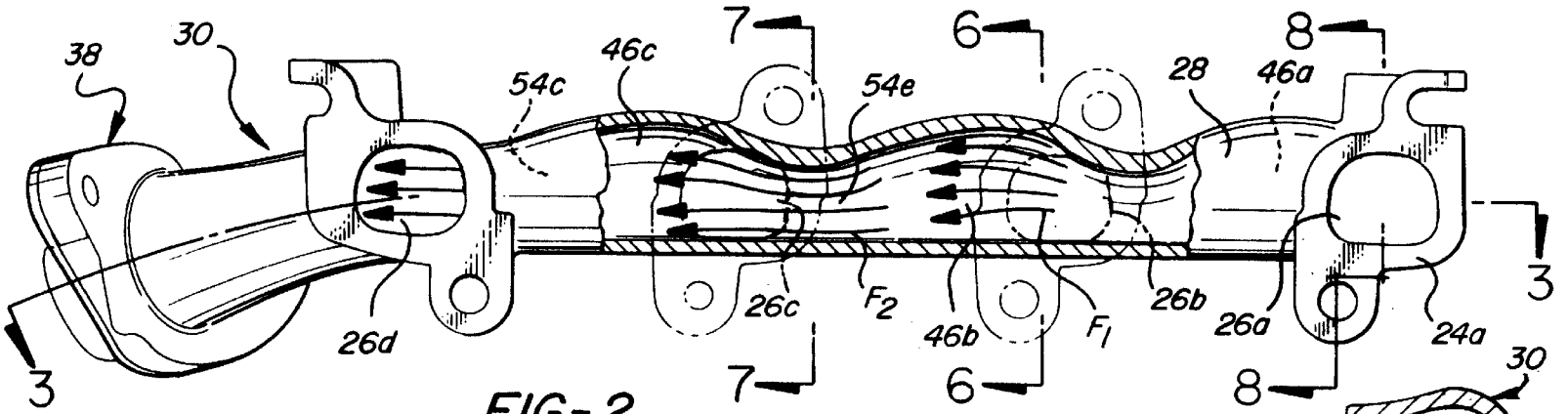
FIG. 2 is an elevational, partially broken away, side view of the exhaust manifold looking away from the engine's cylinder head.

Turning now in greater detail to the drawings particularly FIG. 1, a portion of a vehicle's engine compartment is shown in which an upper portion of a V-8 type internal combustion engine 10 is shown. Specifically, a left cylinder head assembly 12 of engine 10 is illustrated in a position shown upwardly and away from the rest of the engine. As is known in the engine art, a V-8 type engine has two banks of four cylinder bores 14 which are formed in a block portion 15 of the engine. In FIG. 1, the four cylinder bores 14 of the left bank are aligned along the engine's longitudinal dimension. A piston (not shown but well known in the engine art) is reciprocally mounted in each of the cylinder bores 14.

In each cylinder bore 14, the upper end portion of a piston and the main body portion 18 of the cylinder head assembly 12 form a combustion chamber 17 as best seen in FIG. 3A. At least one exhaust valve 16 is associated with each combustion chamber 17 to regulate discharge of exhaust gases therefrom during the exhaust cycle of the engine. The exhaust valve 16 is supported by the body portion 18 of the cylinder head assembly 12 permitting it to open and close so that the associated combustion chamber 17 is isolated from an exhaust passage 21 formed in the body 18 of cylinder head 12. Specifically, during an exhaust cycle of a particular cylinder and combustion chamber, the exhaust valve 16 is moved away from a seating portion 19 formed by the body 18 of the cylinder head 12. This allows exhaust gas to flow past the exhaust outlet port created by the seat portion and from the combustion chamber 17. The exhaust then flows into a passage 21 within the cylinder head body 18 to an exhaust outlet opening 20.

Referring to FIG. 3A, exhaust gases flow through passage 21 at an elevated temperature (e.g. 1900° F.) and at a relatively high velocity (e.g. 1000 ft/sec) in response to the selectively programmed opening of the exhaust valve 16 as is well known in the internal combustion engine art. Typically, in an engine, a rotating camshaft (not shown) operatively engages the upper end portion of a stem portion 22 of the valve 16 forcing it downward from a normal closed position where it engages the seat 19 of the cylinder head body 18. In FIG. 3A, the valve 16 has been moved downward into its opened position to allow exhaust gas to flow from the combustion chamber.

The cross-sectional flow area of the outlet passage 21 in cylinder head body 18 diverges in a flow direction away from exhaust valve 16, that is, the cross-sectional profile steadily increases as best shown in FIG. 3A. The exhaust flow passes from the passage 21 through outlet opening 20 and into an exhaust manifold 30 as shown in FIG. 1.

Figure 3:
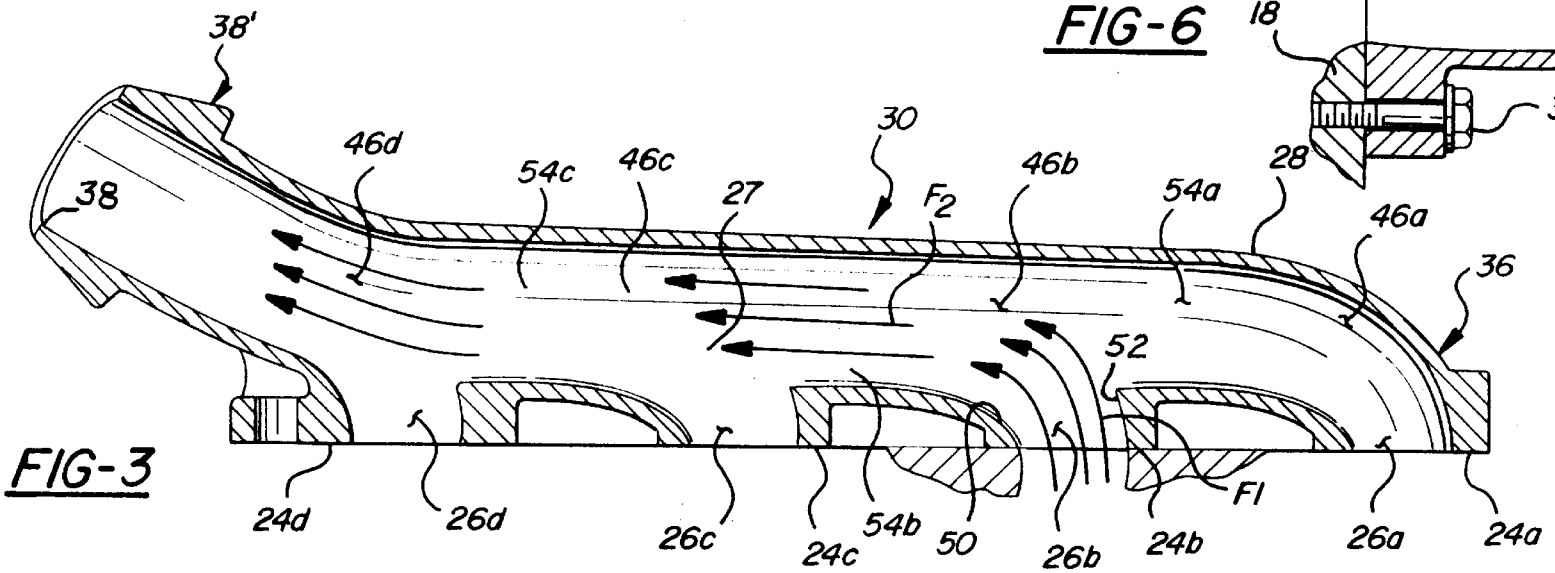
FIG. 3 is a planer and sectional view of the exhaust manifold looking in direction 3—3 shown in FIG. 2.

Specifically as shown in FIG. 1, the exhaust manifold 30 forms a plurality of inlet branch portions 24*a,* 24*b,* 24*c,* and 24*d* arranged in series. Referring to FIGS. 2 and 3, each branch portion defines a passage 26*a,* 26*b,* 26*c,* 26*d* respectively, open to flow from the passages 21 of the cylinder head 18. The passages 26*a,* 26*b,* 26*c,* 26*d* each receive a discharge of exhaust gas from an associated exhaust opening 20 of the engine cylinder head. The flow of exhaust gases in each of the inlet branch portions 24*a,* 24*b,* 24*c,* and 24*d* are turned about ninety degrees from a lateral direction of passage 21 extending away from the cylinder head 18 to the longitudinal direction defined along the length of the cylinder head 18 and manifold 30.

Figure 6:
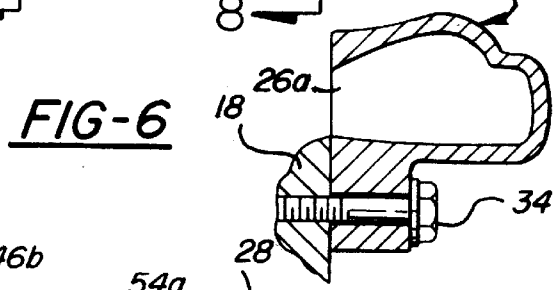
FIG. 6 is a sectioned view of the manifold as attached to the cylinder head and taken along sight line 6—6 in FIG. 2 and looking in the direction of the arrows.

As best seen in FIG. 3, manifold 30 defines an interior flow passage 27 formed by a generally tubular main body portion 28. Tubular body portion 28 generally extends longitudinally. When attached to the associated engine cylinder head 18 as seen in FIGS. 6, 7, and 8, the manifold 30 is secured so as to align its inlet ports 26*a–d* respectively with the outlet openings 20 of the cylinder head 18. Specifically, the manifold 30 is attached to the cylinder head 18 by bolt fasteners 34. Referring to FIGS. 2 and 3, the tubular body portion 28 of manifold 30 has a closed forward end portion 36 and an opened rearward end portion 38 as defining by an encircling flange 38'. As seen in FIG. 1, the flange 38' connects to a manifold outlet or exhaust pipe 40. In turn, the exhaust pipe 40 connects to the inlet of a catalyst converter housing 42. The outlet of the catalyst converter housing 42 is in turn connected to a tail pipe 44.

While only the left cylinder head 18 and it associated exhaust manifold 30 has been shown and referred to in FIG. 1 and the text above, a similar right manifold would obviously be provided for the right cylinder head of the V-8 engine. Other engines such as an I-4 (in-line four cylinder), or an I-6 engine would have only one single bank of cylinders and one cylinder head so that only a single exhaust manifold need be employed. Nevertheless, the specific exhaust gas control principles and construction of the subject manifold are applicable to other engine configurations. The advantages of the compact configuration, its reduced mass, and an improved lower pressure drop through the manifold are achievable with other engine configurations. Also, the improved transmittal of heat to the downstream catalytic converter resulting in an earlier light-off for more effective treatment of exhaust gases would be realized.

The engine compartment space or volume of most current vehicles is very limited and mostly occupied by the engine and its associated transmission and drivetrain assembly. Also, accessory power devices driven by and associated with the engine occupy considerable space and further crowd the engine compartment. Accordingly, a smaller exhaust manifold having a reduced mass and an optimized flow characteristic is needed. As previously mentioned, a manifold with an improved flow and a reduced mass substantially prevents the temperature of the exhaust gases from decreasing in the manifold which is undesirable. Therefore, the temperature of the exhaust gas flowing into the catalytic converter is relatively high soon after a cold engine is started so that the catalyst is quickly brought up to an effective light-off temperature whereafter unburned hydrocarbons are oxidized and other combustion products are converted into water vapor and carbon dioxide.

The compact, low mass manifold 30 of the present invention achieves the above discussed requirements. It provides a manifold characterized by low mass and a relatively short transit time for exhaust gas while in the manifold. Resultantly, the heat loss to the engine compartment is minimized. Further, the exhaust gas temperature is maintained at a relatively high level which promotes a more rapid light-off of the catalyst. Still further, the gas pressure drop from the manifold's inlets to its outlet is low due to a particular diffuser and nozzle flow control configuration. Resultantly, engine performance is enhanced.

Figure 4:
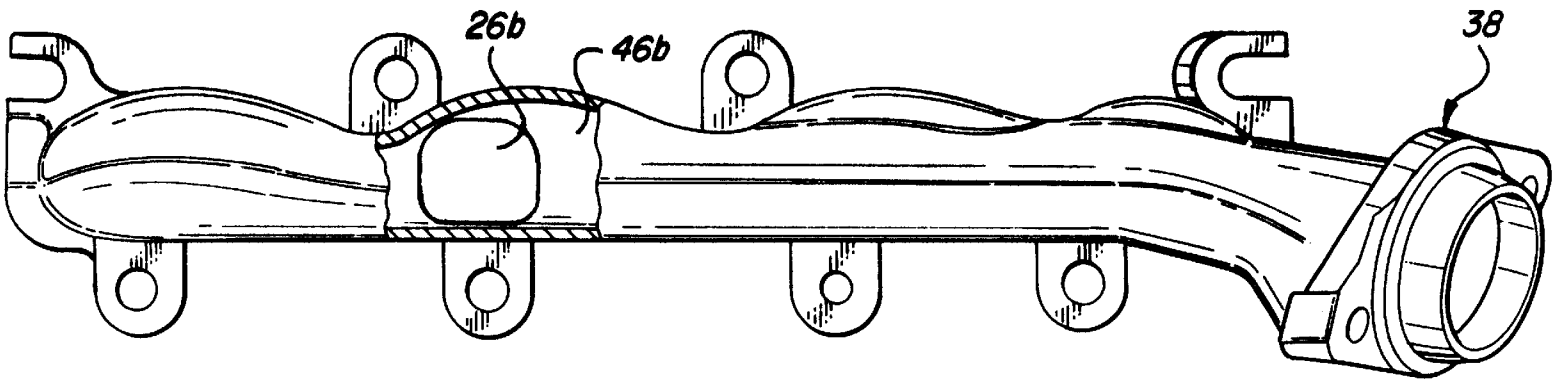
FIG. 4 is an elevational side view of the exhaust manifold shown in FIG. 1 and looking toward the engine cylinder head.
Figure 5:
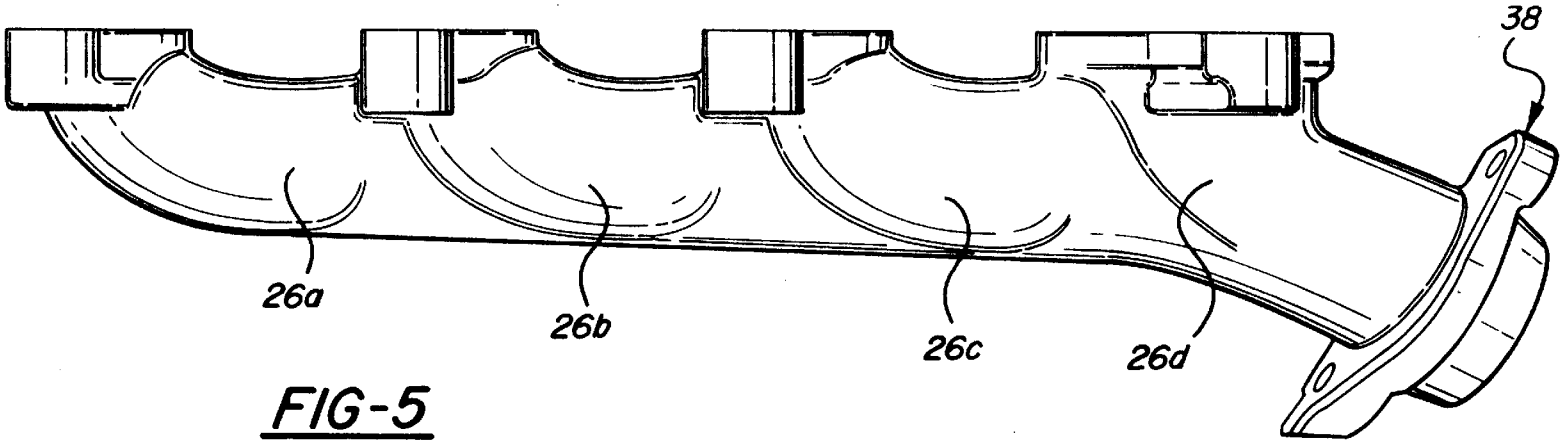
FIG. 5 is a planer top view of the exhaust manifold shown in FIG. 4.

As best shown in FIGS. 3 and 4, manifold 24 includes the plurality of laterally spaced inlet branches 24*a–d* each with an inlet opening which leads to the passages 26*a–d*. Like the passages 21 in the cylinder head 18, the passages 26*a–d* are configured as diffuser portions or sections, e.g., the cross-sectional area increases with increased distance from the inlet end portion towards the interior passage 27. The diffuser sections 26*a–d* each open to the interior, central flow passage 27 within the tubular portion 28. As can be seen in FIG. 4, the diffuser sections 26*a–d* are evident even from the exterior of the manifold by upward and outwardly bulging portions. The progressive enlargement in cross-section of the diffuser sections 26*a–d* from inlet to outlet cause the flow of exhaust gas to decrease in velocity and increase in pressure. In passage through a diffuser section, the flow of exhaust gas turns from a generally lateral direction outward from the cylinder head toward a generally longitudinal direction through the manifold's elongated tubular portion 28. The decrease in gas flow velocity helps to conserve flow energy as the gas flow is turned through approximately ninety degrees.

Method of Operation of Gas Flow Through the Manifold

As each exhaust valve opens for an associated combustion chamber, exhaust gas flows into the respective inlet branches 24*a–d* of the manifold 30. Immediately upon opening of the valve, the gas pressure increases. As shown in FIG. 3, for example, the inlet for branch 24*b* actively receives a flow of exhaust to the diffuser section 26*b* from the corresponding passage 21 with an opened exhaust valve. The gas flow stream is represented by arrows $F_1$. Note that the flow turns about 90° after the flow enters into the inlet branch from the cylinder head 18. A portion 50 of the internal wall of the manifold which extends downstream from the inlet opening for section 26*b* gradually turns to guide the flow slightly upward toward the longitudinal direction. This causes a significant degree of diffusion without risk of boundary layer separation resulting in the flow leaving the surface in turbulence. The surface 52 opposite wall 50 is also gradually curved to cause the flow to turn and be directed longitudinally toward the outlet end of the tubular portion 28 of the manifold 30.

Together, surfaces 50, 52 generally define a kind of air foil shape. In series flow with the gas inlet of a respective branches portion 24*a–d* and an associated diffuser section, the slowed-down gas forms an attached boundary layer relationship with the interior surfaces so flow through the manifold is efficiently carried at reduced velocity and with greatly reduced losses due to friction.

However, after turning of the gas flow through ninety degrees, the kinetic energy of the gas, which reduced by the velocity decrease in the diffuser section, needs to be reclaimed. Accordingly, downstream of each diffuser sections 26*a,* 26*b,* and 26*c,* the manifold configuration is altered to provide a nozzle section or portion 54*a,* 54*b,* and 54*c* respectively as best shown in FIGS. 2 and 3. Each nozzle section 54*a,* 54*b,* and 54*c* is positioned in series with and downstream from a corresponding diffuser portion 26*a,* 26*b,* and 26*c*. As gas passes through a nozzle section, it regains velocity previously reduced by diffusion. Also each of the three nozzle sections 54*a,* 54*b* and 54*c* is strategically located in the manifold immediately ahead of the inlet or gas exhaust opening of an associated downstream inlet branch 24*a,* 24*b* and 24*c*. These nozzle sections cause the gas flow leaving the diffuser section to increase in velocity due to the convergence, e.g., the gradual decrease in the cross-sectional flow area of the passage. Of course, this increase in velocity is accompanied by a decrease in pressure. With kinetic energy transferred from pressure energy of the gas in the nozzle, the high velocity rush of gas "jumps" or "skips" over or past a downstream exhaust port.

For example as in FIGS. 2 and 3, as the gas flow $F_1$ exits the diffuser section 26*b* at relatively low speed and relatively high pressure, it then flows through the next nozzle section 54*b* where the flow velocity is increased and pressure correspondingly decreased as shown by arrows $F_2$. The series positioned diffuser and nozzle sections are so configured that the high pressure in the diffuser is converted into increased velocity in the nozzle portion which is sufficient to jump past the neighboring port 26*c* with a minimum of turbulence and interchange with any relatively slow rate of gas flow therefrom as 26*c* would be relatively inactive as the exhaust valve would be closed.

The reference to a "jump" of gas flow is somewhat analogous to "drafting" as practiced in vehicle racing. In racing, a following or chasing race car will advantageously follow closely behind a leading race car so that the flow of air thereover will bypass the chaser to a substantial degree. When the accelerating exhaust gas flows through the nozzle for inlet branch 26*b,* downstream inlet ports 26*c* and 26*d* are substantially inactive as the associated exhaust valves are closed. The accelerated exhaust flow jumps or passes past port 26*c* by action of the recovery of velocity in the nozzle section 54*b*. Likewise, when inlet 24*c* is receiving flow as its associated exhaust valve is opened, port 26*d* will be similarly jumped by accelerated exhaust flow due to the action of the nozzle 54*c*. Accordingly, with the inactive exhaust ports effectively bypassed by the flow therepast resulting from an upstream diffuser/nozzle combination, large volumes of exhaust gas are efficiently transmitted through the exhaust manifold and flow turbulence is minimized due to a reduction in turbulent interchange and pressure drop as the gas passes an inactive opening.

The other combination of a series flow diffuser section and nozzle section operate in the same manner with each diffuser reducing kinetic energy while the flow direction is changed. Overall fluid flow energy is in proportion to the square of the velocity, a relatively small decrease in fluid pressure corresponds to a relatively large drop in fluid velocity. Accordingly, the turning of flow about ninety degrees is made in a relatively compact or small space without very large pressure losses. The flow velocity can be efficiently recovered in the nozzle sections so that the overall pressure drop through the subject manifold is relatively low and thus there is less back pressure on the engine by the flow through the manifold. This naturally increases engine performance.

With the diffuser and nozzle configurations provided by this invention, a manifold can be reduced in size without penalty so that they effectively require reduced space in the engine compartment of the vehicles and still effectively handle the exhaust and operate for a wide range of engines and engine speeds.

Furthermore, with this diffuser/nozzle construction, the mass of the manifold material is substantially reduced so that heat losses from warming-up a cold manifold are greatly reduced, i.e., the manifold does not operate as a large heat sink. As a result, the flow of hot exhaust gases exits the manifold at high temperature at an accelerated time rate than otherwise. Also, the temperature of gas exiting the manifold is higher which allows the catalyst converter to sooner begin effective operation or be light-off more rapidly. This is very important when the vehicle engine is initially cold and is first started. Under these conditions, the temperature of the exhaust exiting the combustion chambers and manifold normally builds-up from low level. The decreased mass of the subject manifold permits more of the heat from combustion to arrive into the catalyst converter.

While a preferred embodiment of the invention has been shown and described, other embodiments will now become apparent to those skilled in the art. Accordingly, this invention is not to be limited to that which is shown and described but by the following claims.

What is claimed is:

1. A method of efficiently controlling flow of exhaust gases in an exhaust manifold having at least two discrete exhaust inlet branches forming at least two generally laterally extending gas inlet passages and a tubular exhaust housing portion forming a generally longitudinally extending primary gas exhaust flow passage terminating in a gas outlet at one end of said housing portion, the inlet branches being aligned with one another and spaced apart along the length of said primary exhaust housing and each defining a generally radial gas inlet opening directly in the tubular housing portion that is fluidly connected to said primary exhaust gas passage therein and each operatively connected to a separate, associated exhaust port of the associated engine which exhaust ports extend from combustion chambers of a multi-cylinder internal combustion engine, comprising the steps of:

a. flowing exhaust gas from a first combustion chamber to a first inlet branch and through the first inlet opening to said primary exhaust passage at a location upstream of a second adjacent inlet opening to said primary exhaust passage;

b. diffusing the exhaust gas flow upstream of the second adjacent radial inlet opening to reduce the velocity of the flow and increase its pressure while altering the flow direction from a lateral to a longitudinal direction;

c. converging the exhaust gas flow upstream of the second adjacent radial inlet opening to accelerate the flow and thereby increase its velocity by conversion of the higher pressure exhaust gas into kinetic energy thereby boosting the flow velocity sufficiently to cause the flow to effectively bypass the second adjacent radial inlet opening in a manner characterized by minimized gas flow turbulence and pressure loss through said manifold.

2. An exhaust manifold for a multi-cylinder internal combustion engine having a plurality or cylinders and combustion chambers and at least one exhaust valve for each combustion chamber, comprising:

a. a hollow main body portion defined by a generally cylindrical outer wall providing a discrete longitudinally extending and unobstructed primary exhaust gas passage therein terminating in an exhaust gas outlet at one end thereof, b. a plurality of discrete and laterally spaced exhaust gas inlet branch portions disposed along one side of said main body portion and defining substantially radial exhaust gas inlet openings and termination in the outer wall of said main body portion for directly pneumatically connecting said inlet branch portions to said longitudinally extending primary exhaust passage, each of said branch portions adapted to be fluidly connected to the engine so as to receive a flow of exhaust gas from an associated cylinder and combustion chamber as controlled by opening of a corresponding exhaust valve for that cylinder and combustion chamber and delivering the flow directly into said primary exhaust passage, c. each said exhaust gas inlet branch portions and said main body portion adjacent to said associated exhaust gas inlet opening being configured to form an enlarged diameter gas diffuser section for increasing the pressure and reducing the velocity of the exhaust gas flow while facilitating an angular turn of the flow of exhaust gas into said primary exhaust passage d. said main body portion being further configured with a constricted flow nozzle section downstream of each plurality of said gas diffuser sections for subsequently converting the higher pressure and lower velocity gas into a decreased pressure and higher velocity flow wherein the flow of higher velocity exhaust gas passes the next downstream and neighboring exhaust gas inlet opening with a minimum of turbulent gas flow interchange therewith thereby optimizing overall exhaust gas flow and minimizing pressure drop through said manifold.

3. The manifold as set forth in claim 2 wherein said angular turn of the exhaust gas flow is substantially 90 degrees and wherein an inner surface of said manifold immediately downstream of a plurality of said exhaust gas inlet openings has the general shape of an air foil for augmenting the flow of exhaust gas through said primary exhaust passage to said exhaust gas outlet.

4. An exhaust manifold for a multi-cylinder internal combustion engine having a plurality of cylinder and combustion chamber combinations and an exhaust valve for each combination comprising:

a. a main body portion defined by a generally cylindrical outer wall providing a longitudinally extending and unobstructed primary exhaust gas passage terminating in an exhaust gas outlet at one end thereof, b. a plurality of laterally extended exhaust gas inlet branches integral with and arranged longitudinally along one side of the tubular main body portion of the manifold, each inlet branch having a connection adapted to be operatively coupled to a cylinder and combustion chamber combination of the engine for receiving a flow of exhaust gas therefrom, each inlet branch further having an exhaust gas inlet formed radially in the outer wall of the main body portion that directly communicates with said primary exhaust passage of said tubular main body portion, c. each inlet branch and said main body portion associated therewith being enlarged in flow capacity to provide a diverging exhaust diffuser passage extending downstream from said exhaust gas inlet opening for increasing the pressure and reducing the velocity of the exhaust gas flow and being curved to provide an efficient angular change in flow direction characterized by minimal loss of pressure;

d. only said main body portion further shaped to provide a converging nozzle passage downstream from each said diffuser passage for converting the higher pressure, lower velocity flow of gas therefrom into a lower pressure, higher velocity gas flow wherein said higher velocity gas flow in said nozzle passage flows past said next adjacent downstream gas inlet opening characterized by minimal turbulent interchange therewith and minimal pressure loss as the flow passes said next adjacent downstream last mentioned opening.

5. The manifold as set forth in claim 4 wherein each said diffuser portion is provided by said branch inlet associated therewith in conjunction with said main body portion and each said nozzle section is provided by a reduced diameter section of the main body portion immediately downstream of each said diffuser portion.

6. An exhaust manifold for a multi-cylinder internal combustion engine having a plurality of cylinder/combustion chamber sets and at least one exhaust valve for each such set, comprising:

a. a tubular main exhaust member defining an elongated primary and substantially unobstructed exhaust passage terminating in an exhaust gas outlet at one end thereof, b. a plurality of serially aligned and generally laterally extending exhaust gas inlet branches arranged longitudinally along the tubular member, each branch having a connection adapted to fluidly receive exhaust gas from an associated cylinder/combustion chamber set as the associated exhaust valve is opened and each branch having a radial exhaust gas inlet formed directly in the wall of said tubular member emptying into said primary exhaust gas passage, c. each of said branches and said tubular member having continuous inner walls cooperatively defining a diverging diffuser section immediately downstream from said exhaust gas inlet for increasing gas pressure and reducing flow velocity thereby permitting an efficient change in flow direction, d. said tubular member further having a converging nozzle section formed by the inner wall thereof located immediately downstream from said diffuser section for receiving the gas flow from said diffuser section and increasing the velocity and decreasing the pressure of the gas flow so that said gas flow past the next downstream exhaust gas inlet in a manner characterized by a minimized turbulent interchange therewith and a reduced pressure loss.

7. The manifold as set forth in claim 6, wherein each diffuser section is positioned immediately downstream with respect to said associated inlet branch and each nozzle section is directly connected with the outlet of the upstream diffuser section and has an output adjacent to the next downstream inlet branch.

8. An exhaust manifold for a multi-cylinder internal combustion engine having a plurality of cylinders and associated combustion chambers and at least one exhaust valve for each combustion chamber comprising:

a. an elongated main body portion having a generally tubular wall and defining a continuous and substantially unobstructed main exhaust passage that terminates in an exhaust outlet at one end thereof, b. a plurality of exhaust gas inlet branch portions laterally spaced from one another and defining separate gas passages with each being adapted to be operatively connected to an associated exhaust valve of said engine, c. a plurality of laterally spaced and radially extending exhaust gas openings in the tubular wall of said main body portion pneumatically connecting the separate gas passages of said gas inlet branch portions to said main exhaust passage, said exhaust gas openings being located in a series along the length of said tubular wall, d. each said inlet branch portion and said main body portion adjacent to said associated exhaust gas opening being shaped to form an enlarged diameter exhaust gas diffuser section in said main exhaust passage upstream of said next adjacent gas exhaust opening, e. said main body portion of said manifold further having internal walls shaped to provide a restricted diameter portion immediately downstream of each said air diffuser section and immediately upstream of the next adjacent exhaust gas opening to define a restricted diameter nozzle section for accelerating the flow of exhaust gas in said main passage past the associated gas exhaust opening.

* * * * *